US010126036B2

(12) United States Patent
Mitchell et al.

(10) Patent No.: US 10,126,036 B2
(45) Date of Patent: Nov. 13, 2018

(54) ICE MAKER FOR DISPENSING SOFT ICE AND RELATED REFRIGERATION APPLIANCE

(71) Applicant: Haier US Appliance Solutions, Inc., Wilmington, DE (US)

(72) Inventors: Alan Joseph Mitchell, Louisville, KY (US); Andrew Reinhard Krause, La Grange, KY (US)

(73) Assignee: Haier US Appliance Solutions, Inc, Wilmington, DE (US)

( * ) Notice: Subject to any disclaimer, the term of this patent is extended or adjusted under 35 U.S.C. 154(b) by 55 days.

(21) Appl. No.: 15/599,554

(22) Filed: May 19, 2017

(65) Prior Publication Data

US 2017/0254577 A1 Sep. 7, 2017

Related U.S. Application Data

(63) Continuation of application No. 12/948,293, filed on Nov. 17, 2010, now Pat. No. 9,664,430.

(51) Int. Cl.
*F25C 5/182* (2018.01)
*F25D 23/12* (2006.01)

(52) U.S. Cl.
CPC ..... *F25C 5/182* (2013.01); *F25D 23/126* (2013.01); *F25C 2400/08* (2013.01); *F25C 2400/10* (2013.01); *F25C 2400/14* (2013.01); *F25C 2700/04* (2013.01)

(58) Field of Classification Search
CPC .. F25C 5/182; F25C 2400/08; F25C 2400/10; F25C 2700/04; F25C 1/18; F25C 5/22; F25C 5/005; F25D 2321/04
See application file for complete search history.

(56) References Cited

U.S. PATENT DOCUMENTS

| | | | |
|---|---|---|---|
| 2,410,672 | A | 10/1941 | Muffly |
| 2,672,016 | A | 9/1948 | Muffly |
| 2,695,502 | A | 11/1950 | Muffly |
| 7,216,499 | B2 | 5/2007 | Flinner et al. |
| 2007/0186570 | A1 | 8/2007 | Kopf |
| 2009/0293501 | A1 | 12/2009 | Kulkarni et al. |

FOREIGN PATENT DOCUMENTS

WO WO-2009078562 A1 * 6/2009 ..... F25B 5/00

* cited by examiner

*Primary Examiner* — Elizabeth J Martin
(74) *Attorney, Agent, or Firm* — Dority & Manning, P.A.

(57) ABSTRACT

An ice-making assembly for a refrigeration appliance includes an ice maker for making ice cubes. An ice cube storage bin receives ice cubes from the ice maker. The ice cube storage bin is maintained at a temperature above the freezing temperature of water. A drain in communication with the ice cube storage bin for receives water melted from ice cubes located in the storage bin. A related refrigeration appliance is disclosed.

20 Claims, 5 Drawing Sheets

ICE MAKER FOR DISPENSING SOFT ICE AND RELATED REFRIGERATION APPLIANCE

RELATED APPLICATION

The present application claims benefit under 35 U.S.C. § 120 and is a continuation of U.S. patent application Ser. No. 12/948,293, filed Nov. 17, 2010 and published as U.S. Patent Publication No. 2012/0118001 on May 17, 2012, which is incorporated in its entirety by reference herein for all purposes.

FIELD OF THE INVENTION

The subject matter disclosed herein relates generally to an ice maker and related refrigeration appliance for dispensing ice cubes that are maintained above the freezing temperature.

BACKGROUND OF THE INVENTION

Various ice maker designs have been proposed for refrigeration appliances such as commercial or home refrigerators and/or freezers. In certain automatic ice makers, water is provided from an external source to a chilled ice cube mold. Once the water freezes into ice, the ice cubes in the mold are harvested and the cycle is repeated. Ice cube removal can be assisted by a brief heating of the mold to separate the ice cubes from the mold, if desired. Often, a sensor is present to detect an ice level in the ice bucket as ice builds up in the ice bucket as the cycle progresses. If the ice level in the bucket reaches a certain predetermined amount (i.e., the ice bucket is full), the cycle is halted until ice is removed from the ice bucket thereby lowering the ice level. In many refrigeration appliances, this cycle repeats automatically until the ice level sensor indicates a full ice bucket.

Such systems generally work well and as intended to provide a constant supply of ice and full ice bucket when desired. However, ice cubes in an ice bucket held within a freezer compartment that is well below the freezing point of water will naturally get colder until they match the ambient freezer temperature. The ice cubes may therefore become harder and cloudy, and individual ice cubes may freeze together or to the sides of the holding container. Some consumers do not find such colder, cloudy ice cubes preferable, and would rather have ice cubes closer to the freezing temperature.

However, in typical refrigeration appliances having refrigerator portions and freezer portions, neither of these portions is typically held at such a temperature near the freezing temperature of water. Accordingly, an improved design would be welcome for an ice maker wherein ice cubes are provided at a temperature more approximating the freezing temperature of water, and not substantially below such temperature, from a conventional refrigeration appliance.

BRIEF DESCRIPTION OF THE INVENTION

Aspects and advantages of the invention will be set forth in part in the following description, or may be obvious from the description, or may be learned through practice of the invention.

According to certain aspects of the disclosure, an ice-making assembly for a refrigeration appliance includes an ice maker for making ice cubes. An ice cube storage bin receives ice cubes from the ice maker. The ice cube storage bin is maintained at a temperature above the freezing temperature of water. A drain in communication with the ice cube storage bin for receives water melted from ice cubes located in the storage bin. Various options and modifications are possible.

According to certain other aspects of the disclosure, a refrigeration appliance includes a refrigeration cabinet with a refrigerator portion maintained at a temperature above the freezing temperature of water and a freezer portion maintained at a temperature below the freezing temperature of water. An ice maker is located within the refrigeration cabinet for making ice cubes. An ice cube storage bin within the refrigerator portion receives ice cubes from the ice maker. A drain in communication with the ice cube storage bin receives water melted from ice cubes located in the storage bin. As above, various options and modifications are possible.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
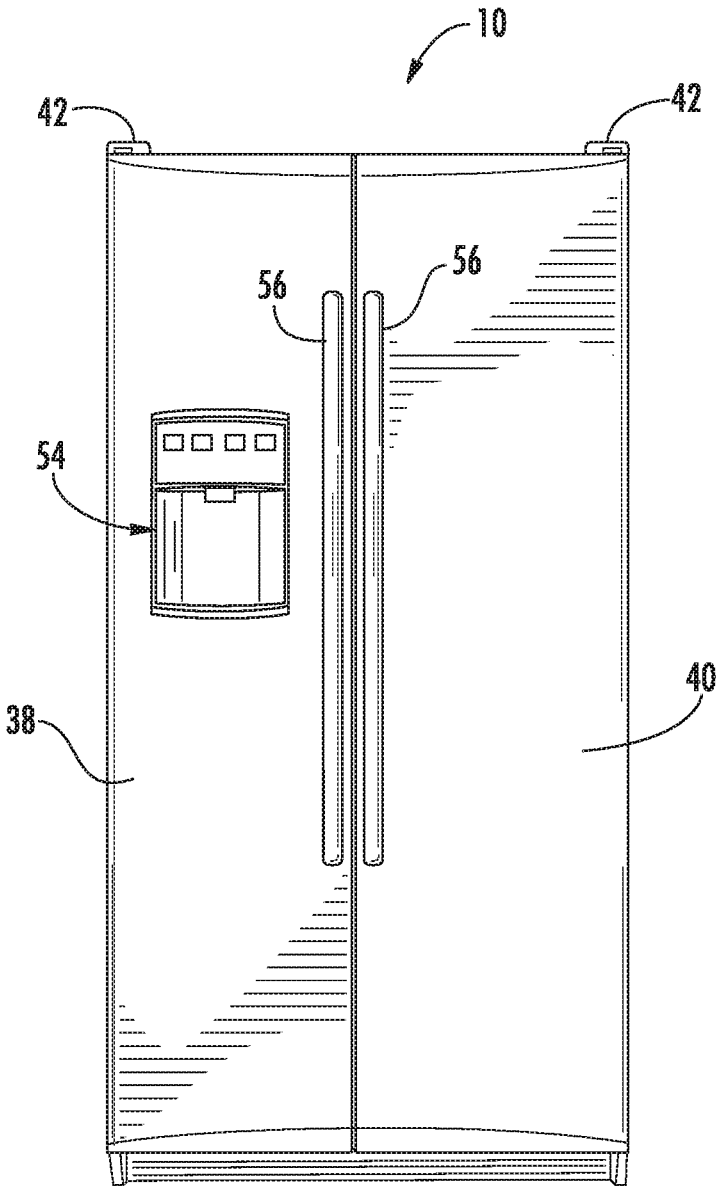
FIG. 1 provides a front view of a refrigeration appliance with its doors closed.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 is a frontal view of an exemplary refrigeration appliance 10 depicted as a refrigerator in which dispenser target indicating assemblies in accordance with aspects of the present invention may be utilized. It should be appreciated that the appliance of FIG. 1 is for illustrative purposes only and that the present invention is not limited to any particular type, style, or configuration of refrigeration appliance, and that such appliance may include any manner of refrigerator, freezer, refrigerator/freezer combination, and so forth. The present disclosure may be especially suitable for a compact refrigerator and/or freezer appliance where space is at a premium and an ice-making capability is desired. However, the disclosed ice-making assembly may be used with any such appliance.

Figure 2:
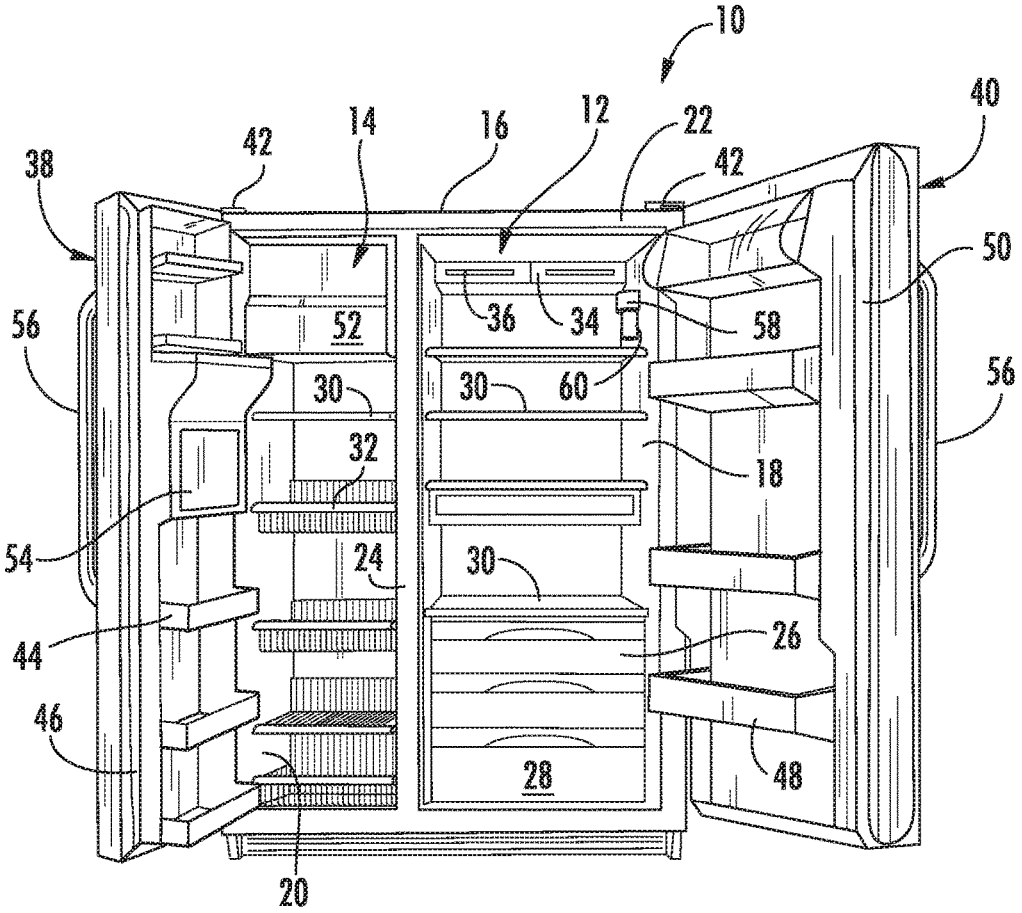
FIG. 2 provides a front view of the refrigeration appliance of FIG. 1 with its doors opened.

Referring to FIG. 2 the refrigerator 10 includes a fresh food storage compartment 12 and a freezer storage compartment 14, with the compartments arranged side-by-side and contained within an outer case 16 and inner liners 18 and 20 generally molded from a suitable plastic material. In smaller refrigerators 10, a single liner is formed and a mullion spans between opposite sides of the liner to divide it into a freezer storage compartment and a fresh food storage compartment. The outer case 16 is normally formed by folding a sheet of a suitable material, such as pre-painted steel, into an inverted U-shape to form top and side walls of the outer case 16. A bottom wall of the outer case 16 normally is formed separately and attached to the case side walls and to a bottom frame that provides support for refrigerator 10.

A breaker strip 22 extends between a case front flange and outer front edges of inner liners 18 and 20. The breaker strip 22 is formed from a suitable resilient material, such as an extruded acrylo-butadiene-styrene based material (commonly referred to as ABS). The insulation in the space between inner liners 18 and 20 is covered by another strip of suitable resilient material, which also commonly is referred to as a mullion 24 and may be formed of an extruded ABS material. Breaker strip 22 and mullion 24 form a front face, and extend completely around inner peripheral edges of the outer case 16 and vertically between inner liners 18 and 20.

Slide-out drawers 26, a storage bin 28 and shelves 30 are normally provided in fresh food storage compartment 12 to support items being stored therein. In addition, at least one shelf 30 and at least one wire basket 32 are also provided in freezer storage compartment 14.

The refrigerator features are controlled by a controller 34 according to user preference via manipulation of a control interface 36 mounted in an upper region of fresh food storage compartment 12 and coupled to the controller 34. As used herein, the term "controller" is not limited to just those integrated circuits referred to in the art as microprocessor, but broadly refers to computers, processors, microcontrollers, microcomputers, programmable logic controllers, application specific integrated circuits, and other programmable circuits, and these terms are used interchangeably herein.

A freezer door 38 and a fresh food door 40 close access openings to freezer storage compartment 14 and fresh food storage compartment 12. Each door 38, 40 is mounted by a top hinge 42 and a bottom hinge (not shown) to rotate about its outer vertical edge between an open position, as shown in FIG. 1, and a closed position. The freezer door 38 may include a plurality of storage shelves 44 and a sealing gasket 46, and fresh food door 40 also includes a plurality of storage shelves 48 and a sealing gasket 50.

The freezer storage compartment 14 may include an automatic ice maker 52 and a dispenser 54 provided in the freezer door 38 such that ice and/or chilled water can be dispensed without opening the freezer door 38, as is well known in the art. Doors 38 and 40 may be opened by handles 56 is conventional. A housing 58 may hold a water filter 60 used to filter water for the ice maker 52 and/or dispenser 54.

As with known refrigerators, the refrigerator 10 also includes a machinery compartment (not shown) that at least partially contains components for executing a known vapor compression cycle for cooling air. The components include a compressor, a condenser, an expansion device, and an evaporator connected in series as a loop and charged with a refrigerant. The evaporator is a type of heat exchanger which transfers heat from air passing over the evaporator to the refrigerant flowing through the evaporator, thereby causing the refrigerant to vaporize. The cooled air is used to refrigerate one or more refrigerator or freezer compartments via fans. Also, a cooling loop can be added to directly cool the ice maker to form ice cubes, and a heating loop can be added to help remove ice from the ice maker. Collectively, the vapor compression cycle components in a refrigeration circuit, associated fans, and associated compartments are conventionally referred to as a sealed system. The construction and operation of the sealed system are well known to those skilled in the art.

Figure 3:
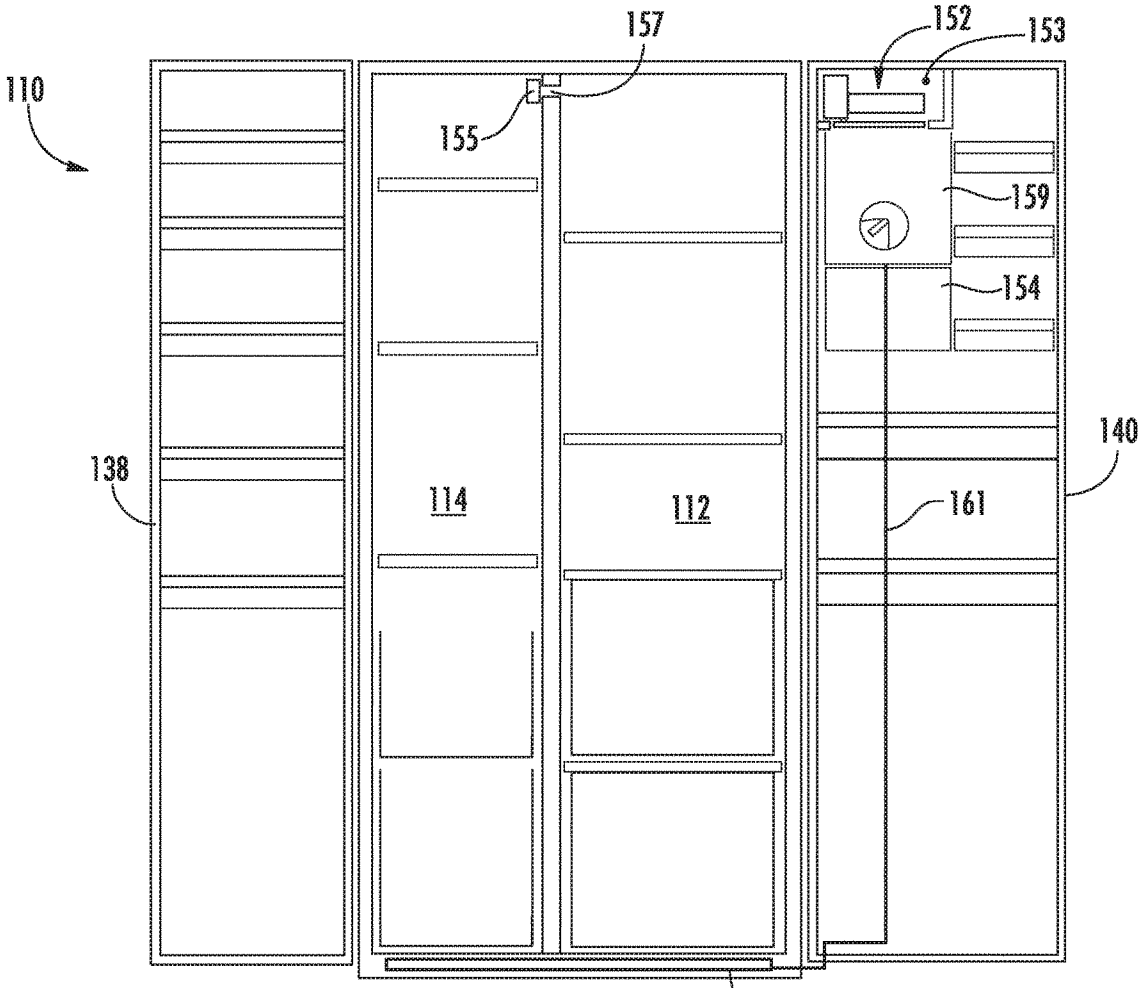
FIG. 3 provides a diagrammatical front view of an ice making assembly within a side by side refrigeration appliance (such as shown in FIGS. 1 and 2) with ice making and storing components on a refrigeration compartment door.
Figure 4:
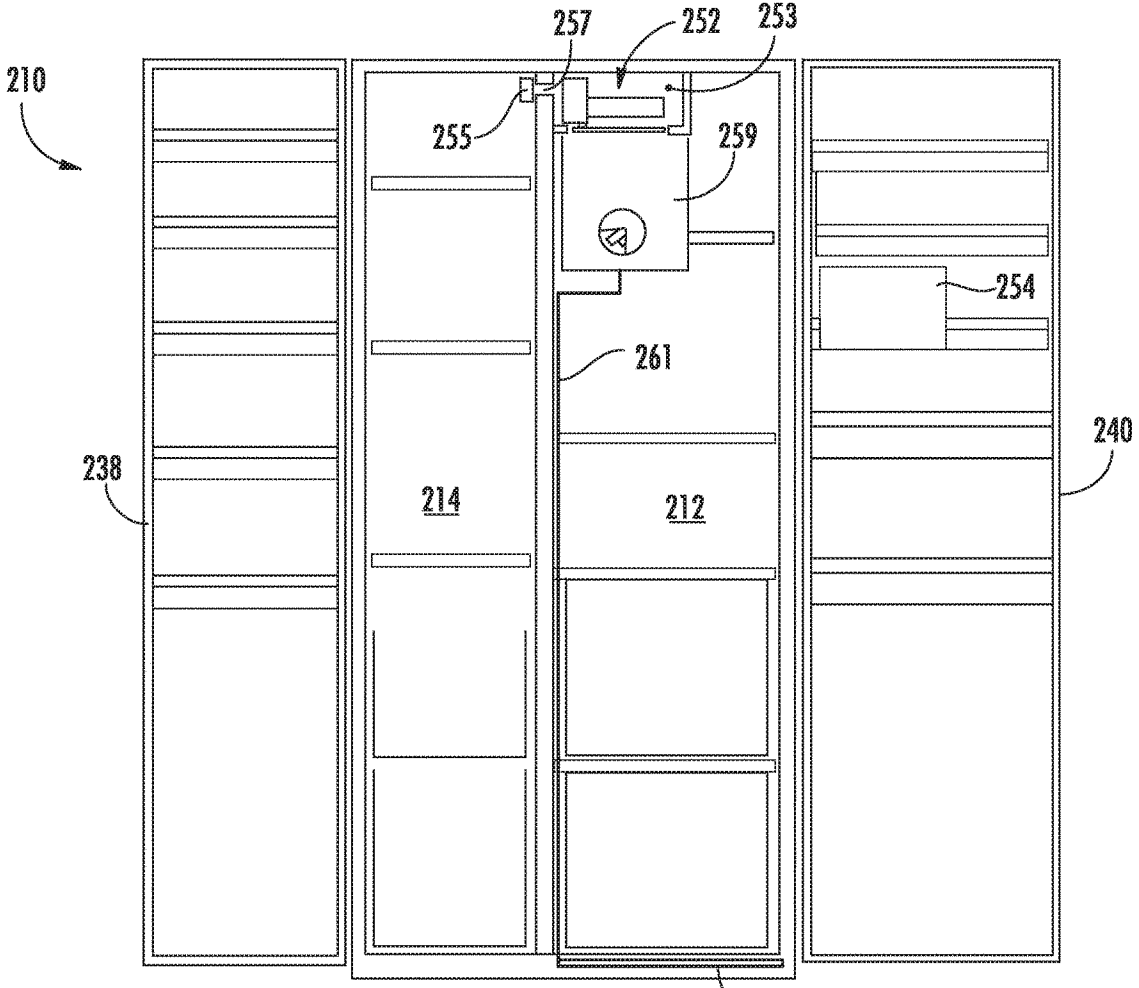
FIG. 4 provides a diagrammatical front view of an ice making assembly as in FIG. 3, modified to place ice making and storing components on the refrigeration compartment cabinet rather than the door.
Figure 5:
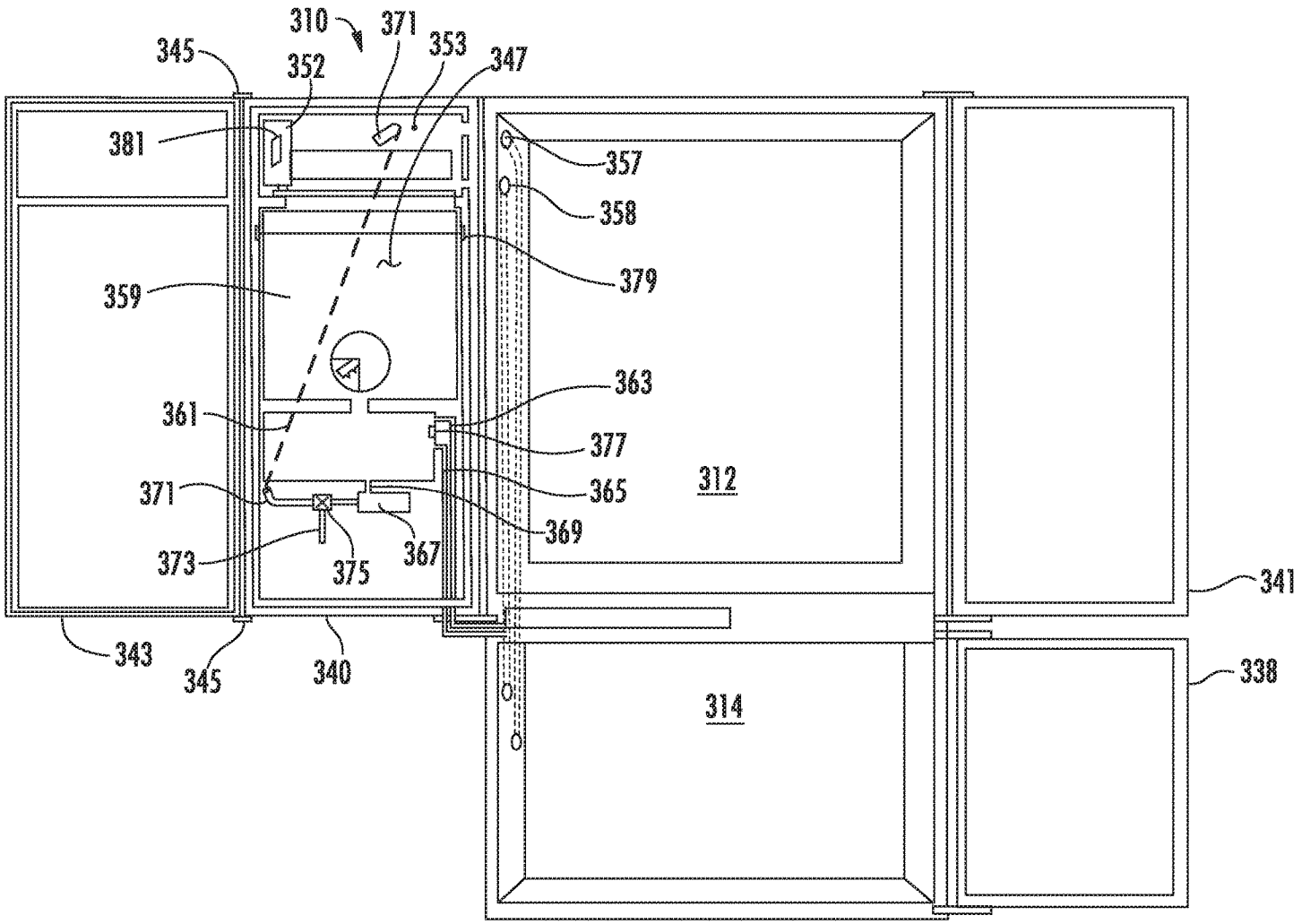
FIG. 5 provides a diagrammatical front view of an ice making assembly within a freezer compartment on the bottom of a refrigeration appliance according to certain other aspects of the present disclosure.

FIGS. 3-5 show diagrammatical examples of refrigeration appliances for dispensing soft ice cubes according to various aspects of the present invention. The "soft ice" formed is stored in an ice bucket just above the freezing temperature for ready dispensing to a user. Such soft ice is often desired by consumers as it is generally visibly clearer than and not as hard as ice maintained at a temperature well below the freezing point, as in some freezers. Water from melted ice can be drained to a water reservoir for later reuse or dispensing, or to an evaporation pan.

As shown in FIG. 3, refrigeration appliance 110 includes a refrigerator compartment 112 and a freezer compartment 114 with doors 138 and 140, as above. The various other elements and options described above with reference to FIGS. 1 and 2 may be employed with the devices of FIGS. 3-5, if desired, so they are not discussed in great detail below.

An ice maker 152 is provided in an ice making chamber 153 in door 140. Chamber 153 is cooled by a fan 155 blowing chilled air though an opening 157 between freezer compartment 114 and refrigerator compartment 112. Therefore, although ice maker 152 is on the "refrigerator side" of the side by side refrigeration appliance, it is cooled to the temperature of the "freezer side." Alternatively, ice maker 152 could be cooled by an included cold plate, a refrigerant loop in the refrigeration cycle, thermoelectric device, or by other such means. Therefore, as shown chamber 153 is cooled to a freezing temperature, but it need not be if ice maker 152 itself is directly cooled to such temperature. Further, ice maker 152 need no be kept in any chamber or compartment below the freezing point, in some applications. Therefore, ice maker 152 could be located within refrigerator compartment 112 (which is above freezing), and the icemaker could be directly cooled, for example, via a thermoelectric device, cold plate and dedicated refrigerant loop, etc.

Ice cubes made in ice maker 152 drop into ice bucket 159 for storage, and then through conventional dispenser 154 when desired. As with conventional ice buckets, ice bucket 159 may be fixed in place or removable, as desired. Ice bucket 159 is maintained at the temperature above freezing, for example at the temperature of the refrigerator compartment 112, or at a temperature above freezing yet between that of the refrigerator compartment and the freezer compartment 114. In other words, some mixing of air between the refrigerator and freezer compartments 112 and 114 might be possible, or some supplemental cooling of ice bucket 159 or a compartment in which is it located is also possible, to slow melting of ice in ice bucket 159 if desired. A seal, gasket, trapdoor, etc., may be provided between chamber 153 and ice bucket 159 if desired to help maintain temperatures in each location.

A drain line 161 is provided at the bottom of ice bucket 159 to drain off water from melted ice. Drain line 161 may lead to an evaporation pan 163, as shown. Alternatively, as discussed below, drain line 161 may lead to a water reservoir or dispenser, recycling system, drain, pump or ice maker in some fashion.

Therefore, the arrangement of FIG. 3 provides soft ice maintained at a temperature above freezing, as desired by many consumers. The ice is made on the refrigerator side of the refrigeration appliance 110. Elements of the system such as ice maker 152, ice bucket 159, and dispenser 154 are located on door 140. It should be understood that any type of ice maker could be employed as ice maker 152, such as conventional automatic multi-compartment ice makers, float ice makers, spray ice makers, etc. It is thus within the purview of one skilled in the art to select an ice maker for use in the present device.

FIG. 4 shows a modified version of a refrigeration appliance 210 and ice maker 252. As shown therein, elements have been moved from door 240 to refrigerator compartment 212. As shown, ice maker 252 within chamber 253 optionally receives cooled air from freezer compartment 214, although direct cooling is possible as mentioned above. Ducting, sealing, etc., may be simpler if ice maker 252 in particular is mounted to the compartment 212 rather than the door 240. As an option, the arrangements of FIGS. 3 and 4 may be combined. That is, ice maker 252 may be located as shown in FIG. 4 (in the compartment) and one or both of ice bucket 259 and dispenser 254 may be located as shown in FIG. 3 (on the door), or vice versa. Such are matters of design choice as to how to use the various spaces provided within the compartments and doors of the refrigeration appliances.

FIG. 5 shows an alternate refrigeration appliance 310, with a refrigerator compartment 312 on top and a freezer compartment 314 on bottom. Refrigerator compartment 312 includes two doors 340 and 341. Door 340 has an inner door 343 attached to door 340 by hinges 345.

An ice making and storing compartment 347 is located between doors 340 and 343. An ice making chamber 353 is located within compartment 347. Ice maker 352 is located within chamber 353, which is optionally cooled by air circulating through an inlet 357 and outlet 358 communicating with freezer compartment 314, or ice maker 352 can be direct cooled in some fashion as mentioned above. Ice bucket 359 is located outside of chamber 353, so as to be at a temperature above freezing, such as described above. Accordingly, ice maker 352 within ice making chamber 353 is maintained cold enough to make ice, although the ice maker is attached to door 340 of refrigerator compartment 312, and ice bucket 359 is maintained above freezing. It should be understood that for these additional embodiments as above, the use of below freezing chambers 253, 353 is not necessary, and that ice makers 252, 352 may be held in an area above the freezing temperature with direct cooling.

The water supply system for refrigeration appliance 310 is more complicated than above so as to offer additional functionality. For example, water from melting ice in ice bucket 359 flows into a reservoir 361. An overflow outlet 363 can be provided to transfer excess water to an evaporation pan, as above. An inlet 365 can be provided to fill reservoir 361. A pump 367 can be provided to remove water via a pump outlet 369 to supply water via conduit 371 to ice maker 352 or via conduit 373 to a dispenser such as dispenser 54 in FIG. 1. A valve 375 (or multiple valves) may be present to control flow out of reservoir 361 via pump 367 when desired. A sensor 377 can be provided to indicate a water level (low indicating refilling is needed or high, indicating refilling should stop). If desired two such sensors could be provided. One or more sensors 379 can also be provided for detecting the ice level in ice bucket 359. A controller 381 in ice maker 352 (or main controller 34, or both) can be used to control aspects of the water system.

For example, upon start of the refrigeration appliance, water would be provided to reservoir 361 until sensor(s) 377 indicate a full reservoir. Water can then be pumped to ice maker 352, and reservoir refilled by the amount of removed water, if needed. Reservoir 361 is then chilled to the about refrigeration compartment temperature 312 for providing chilled water to a user, and ice is made in ice maker 352. As ice maker 352 cycles and makes more ice, the ice fills ice bucket 359 until sensor(s) 379 indicate a full ice bucket. With each ice making cycle, water removed from reservoir 361 can be refilled. If ice is dispensed from ice bucket 359, the ice maker cycle can be restarted. Even if no ice is dispensed, eventually the ice will melt enough that sensor(s) 379 indicate that more ice can be made, and ice making and reservoir refilling is done again until the ice bucket is refilled. Beneficially, water dripping off ice cubes in ice bucket 359 will be very cold, helping maintain the low temperature of chilled water in reservoir 361. If reservoir 361 is being cooled by air at the temperature of refrigerator compartment 312, generally up to about 40 degrees F. in many cases, the temperature of dispensed water will likely be colder than that due to the ice melt drip, allowing the dispensed water from the reservoir to be very cold, as desired by some consumers. As above, the device of FIG. 5 can be modified in several ways, such as placing some or all of the components in the refrigerator or freezer compartments.

In view of the above, various designs and options are provided for a system in which highly desirable soft ice and chilled water can be provided to consumers. The ice buckets may be held in locations above the freezing point, while the ice makers can be held in locations below or above the freezing point. Insulated compartments, gaskets, seals, trapdoors, etc. can be provided between elements of different temperature where desired. Components can be mounted on a refrigerator or freezer door or cabinet or within a door compartment. The systems can be highly automated for advanced functionality or relatively more simplistic.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An ice-making assembly for a refrigeration appliance, comprising:

a sealed system operable to generate cooled air at one or more evaporators of the sealed system;

one or more fans operable to circulate the cooled air;

an ice maker operable to make ice cubes, the ice maker chillable by the cooled air during operation of the sealed system such that liquid water within the ice maker is chilled to a temperature less than a freezing temperature of water;

an ice cube storage bin positioned for receiving the ice cubes from the ice maker, the ice cube storage bin and the ice cubes within the ice cube storage bin exposed to the cooled air such that the ice cubes within the ice cube storage bin are maintained at a temperature greater than the freezing temperature of water by the cooled air and the ice cubes within the ice cube storage bin melt while stored within the ice cube storage bin; and a pump operable to flow the liquid water melted from the ice cubes located in the ice cube storage bin.

2. The ice making assembly of claim 1, wherein the ice maker is located within an ice-making chamber of the refrigeration appliance which is maintained at a temperature sufficient to form ice.

3. The ice making assembly of claim 1, wherein the ice maker is located within an ice-making compartment defined within a door of the refrigeration appliance.

4. The ice making assembly of claim 1, further comprising a reservoir and a recirculation conduit, the reservoir positioned for receiving the liquid water melted from the ice cubes located in the ice cube storage bin, the recirculation conduit extending between the reservoir and the ice maker, the pump operable to flow the liquid water in the reservoir to the ice maker through the recirculation conduit.

5. The ice-making assembly of claim 4, further comprising a liquid water dispenser, the liquid water dispenser configured for dispensing liquid water held in the reservoir.

6. The ice-making assembly of claim 5, further comprising a dispensing conduit that extends between the reservoir and the liquid water dispenser, the pump operable to flow the liquid water in the reservoir to the liquid water dispenser through the dispensing conduit.

7. The ice-making assembly of claim 5, further comprising a valve coupled to the recirculation conduit and the dispensing conduit, the valve operable to allow the liquid water in the reservoir to flow to either the ice maker through the recirculation conduit or the liquid water dispenser through the dispensing conduit during operation of the pump.

8. The ice-making assembly of claim 4, further comprising an inlet conduit, the inlet conduit connectable to a liquid water supply and the reservoir such that the liquid water supply selectively supplies liquid water to the reservoir.

9. The ice-making assembly of claim 7, further including a sensor in the reservoir for sensing a level of liquid water, the water supply supplying liquid water to the reservoir depending on the level of liquid water sensed by the sensor.

10. The ice-making assembly of claim 4, further comprising a drain line and an evaporation pan, the drain line extending between the reservoir and the evaporation pan in order to place the evaporation pan in communication with the reservoir such that the drain line directs excess liquid water melted from the ice cubes located in the ice cube storage bin to the evaporation pan, the evaporation pan configured for facilitating evaporation of the excess liquid water melted from the ice cubes within the evaporation pan.

11. A refrigeration appliance, comprising:

a cabinet having a fresh food portion and a freezer portion;

a sealed system operable to generate cooled air at one or more evaporators of the sealed system;

one or more fans operable to circulate the cooled air within the cabinet;

an ice maker positioned within the cabinet, the ice maker operable to make ice cubes, the ice maker chillable by the cooled air during operation of the sealed system such that liquid water within the ice maker is chilled to a temperature less than a freezing temperature of water;

an ice cube storage bin positioned below the ice maker within the cabinet such that the ice cube storage bin receives the ice cubes from the ice maker, the ice cube storage bin and the ice cubes within the ice cube storage bin exposed to the cooled air such that the ice cubes within the ice cube storage bin are maintained at a temperature greater than the freezing temperature of water by the cooled air and the ice cubes within the ice cube storage bin melt while stored within the ice cube storage bin; and a pump operable to flow the liquid water melted from the ice cubes located in the ice cube storage bin.

12. The refrigeration appliance of claim 11, further comprising a door rotatably mounted to the cabinet, the door selectively adjustable between an open position and a closed position in order to permit selective access to the fresh food portion of the refrigeration cabinet, the ice maker positioned within an ice-making compartment defined by the door, the cooled air within the ice-making compartment having a temperature less than the freezing temperature of water during operation of the sealed system.

13. The refrigeration appliance of claim 11, a reservoir and a recirculation conduit, the reservoir positioned for receiving the liquid water melted from the ice cubes located in the ice cube storage bin, the recirculation conduit extending between the reservoir and the ice maker, the pump operable to flow the liquid water in the reservoir to the ice maker through the recirculation conduit.

14. The refrigeration appliance of claim 13, further comprising a liquid water dispenser positioned on the door, the liquid water dispenser configured for dispensing liquid water held in the reservoir.

15. The refrigeration appliance of claim 14, further comprising a dispensing conduit that extends between the reservoir and the liquid water dispenser, the pump operable to flow the liquid water in the reservoir to the liquid water dispenser through the dispensing conduit.

16. The refrigeration appliance of claim 15, further comprising a valve coupled to the recirculation conduit and the dispensing conduit, the valve operable to allow the liquid water in the reservoir to flow to either the ice maker through the recirculation conduit or the liquid water dispenser through the dispensing conduit during operation of the pump.

17. The refrigeration appliance of claim 15, further including a sensor in the reservoir for sensing a level of liquid water, the water supply supplying liquid water to the reservoir depending on the level of liquid water sensed by the sensor.

18. The refrigeration appliance of claim 13, further comprising an inlet conduit, the inlet conduit connectable to a liquid water supply and the reservoir such that the liquid water supply selectively supplies liquid water to the reservoir.

19. The refrigeration appliance of claim 13, further comprising a drain line and an evaporation pan positioned within the cabinet, the drain line extending between the reservoir and the evaporation pan in order to place the evaporation pan in communication with the reservoir such that the drain line directs excess liquid water melted from the ice cubes located in the ice cube storage bin to the evaporation pan, the evaporation pan configured for facilitating evaporation of the excess liquid water melted from the ice cubes within the evaporation pan.

20. A method for operating a refrigerator appliance having a cabinet that defines a freezer compartment and a fresh food compartment, comprising:

forming ice cubes with an ice maker of the refrigerator appliance;

depositing the ice cubes within an ice cube storage bin of the refrigerator appliance;

maintaining the ice cubes within the ice cube storage bin at a select temperature, the select temperature being greater than a freezing temperature of water such that the ice cubes within the ice cube storage bin melt during said step of maintaining; and pumping liquid water from the ice cubes within the ice cube storage bin to another location within a cabinet of the refrigerator appliance.

* * * * *